United States Patent [19]

Walker

[11] 4,398,444

[45] Aug. 16, 1983

[54] PLECTRUM

[76] Inventor: John Walker, 2, Hurst Close, Hook Heath Rd., Woking, Surrey GU22 0DU, England

[21] Appl. No.: 343,945

[22] Filed: Jan. 29, 1982

[30] Foreign Application Priority Data

Feb. 9, 1981 [GB] United Kingdom ..... 8103927

[51] Int. Cl.[3] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 768,241 | 8/1904 | Seidel | 84/322 |
| 2,221,234 | 11/1940 | Frasier | 84/322 |
| 2,484,820 | 10/1949 | Galetzky | 84/322 |
| 3,312,137 | 4/1967 | Oddo | 84/322 |
| 4,248,128 | 2/1981 | Des Gaines | 84/322 |

*Primary Examiner*—Lawrence R. Franklin

*Attorney, Agent, or Firm*—Murray Schaffer

[57] ABSTRACT

The invention relates to a plectrum 1 or 10 which has means 2 or 11 which can strike a string of a stringed musical instrument a plurality of times during a single playing stroke. This provides an enchanced, more complicated, sound as compared to that produced by a single strike on a string.

6 Claims, 6 Drawing Figures

PLECTRUM

BACKGROUND OF THE INVENTION

The invention relates to a plectrum for playing a stringed musical instrument.

A known plectrum is generally held between the forefinger and thumb of a musician playing a stringed musical instrument such as a guitar. During a playing stroke the plectrum strikes a string of the instrument once during a single playing stroke.

Sometimes it is desired to produce a more complicated sound than that produced by a single striking of a string. A known plectrum cannot generally produce a more complicated sound than that of a single strike of a string.

SUMMARY OF THE INVENTION

It is an object of the invention to seek to produce a plectrum that can avoid the disadvantages of the prior art.

According to the invention there is provided a plectrum for playing a stringed musical instrument, comprising means for striking a string of the instrument a plurality of times during a single playing stroke.

Using the invention it is possible to provide a complex resonance from striking a string in a single playing stroke.

The means may comprise a bifurcated or trifurcated striking means for striking a string twice during the playing stroke.

The first said striking means strikes the string and sets up an advance resonance. The second striking means of said means strikes the string and the first advance resonance complicates and strengthens the resonance of the second strike on the string by the second striking means.

Two plectrums embodying the invention are hereinbefore described, by way of example, with reference to the accompanying drawings.

DESCRIPTION OF THE PREFERRED EMBODIMENTS

Figure 1:
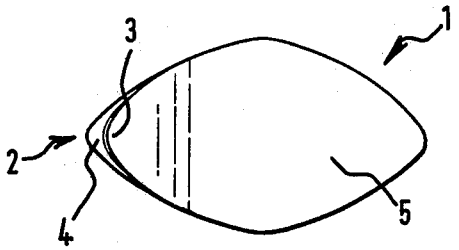
FIGS. 1, 2 and 3 are plan, side and end elevations of a first plectrum according to the invention.
Figure 2:
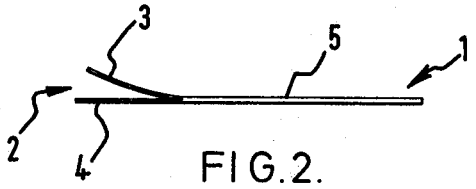
Figure 3:
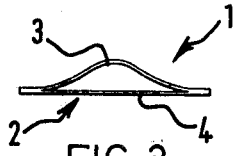

Referring first of all to FIGS. 1 to 3, the plectrum 1 shown is for striking a string of a musical instrument once on a back stroke and twice during a down stroke. The plectrum 1 has a string striking means 2 which is bifurcated.

The striking means 2 comprises a first string striking means 3 and spaced therefrom, in the direction of a down stroke, a second string striking means 4 which is coplanar with a body 5 of the plectrum 1, which body 5 is gripped by the player during playing. The striking means is carried by the body. Thus during the use of the plectrum 1 the first string striking means 3 strikes the string of the guitar (assuming a guitar is being played) and sets up an advance resonance. The second string striking means 4 then strikes the string and the advance resonance complicates and strengthens the resonance of the second strike on the string by the second string striking means 4.

The general effect is that of providing the sound of a twelve string guitar on a six string guitar.

On a back stroke the plectrum 1 strikes the string once, and gives a normal sound.

Figure 4:
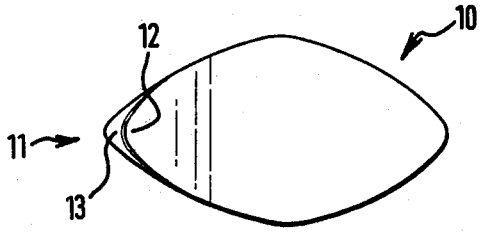
FIGS. 4, 5 and 6 are plan, side and end elevations of a second plectrum according to the invention.
Figure 5:
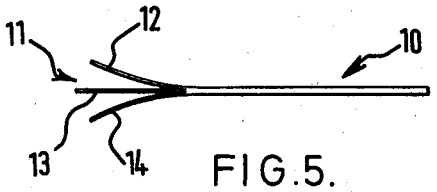
Figure 6:
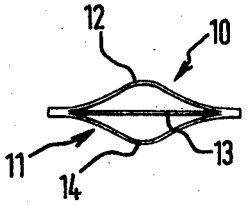

FIGS. 4 to 6 show a plectrum 10 which has a body which is gripped by a player and a string striking means 11 which is trifurcated and which is carried by the body. The means is symmetrical about the part 13 which is co-planar with the body, there being first 12 and third 14 parts respectively for striking a string on a down and back stroke, respectively, or vice versa. The first part 12 and third part 14 are on opposite sides of the part 13, and angled in relation thereto.

The plectrum 10 is twice the lateral width (as viewed in FIGS. 2 and 5) of the plectrum 1.

The plectrums 1 and 10 may be made from plastics such as nylon, wood, metal, bone or any other suitable material. Also, it will be understood that the plectrums could strike a string three or four times in a single playing stroke. In every embodiment, the result is an increase in plectrum noise over that of known plectrums. Also, the plectrum 1 may be used to pick single strings relatively easily, which may be necessary in solos.

I claim:

1. A plectrum for a stringed musical instrument comprising a relatively thin body of substantially planar form having a section adapted to be gripped by a player and a section along one edge having at least two outwardly extending pick members lying in direct opposition to each other, one of said pick members being coplanar with said gripping section and the remaining pick member being inclined from said one coplanar pick member whereby said plectrum may be employed to selectively strike a string of the instrument one or more times during a single stroke.

2. The plectrum according to claim 1 wherein said body is an integral member and is split along a plane central of the upper and lower surfaces of said body defining an upper and a lower pick member, said lower pick member being co-planar with said upper pick member being inclined upwardly out of the plane of said body member.

3. The plectrum according to claim 2 wherein said body is oval and said split end section is at a pointed end thereof.

4. The plectrum according to claim 1 wherein said body is an integral member and is split on two parallel planes between the upper and lower surfaces thereof to form an upper pick member, a lower pick member, and an intermediate pick member, said intermediate pick member being coplanar with said gripping section and said upper and lower pick members being inclined with respect to said intermediate members in opposite directions therefrom.

5. The plectrum according to claim 4 wherein said body is oval and said split end section is at a pointed end thereof.

6. The plectrum according to claim 1 wherein said body is oval and said split end section is at a pointed end thereof.

* * * * *